US011305561B2

(12) United States Patent
Hodai

(10) Patent No.: US 11,305,561 B2
(45) Date of Patent: Apr. 19, 2022

(54) PRINTER

(71) Applicant: PHOENIX CO., LTD., Tokyo (JP)

(72) Inventor: Akira Hodai, Chiyoda-ku (JP)

(73) Assignee: PHOENIX CO., LTD., Tokyo (JP)

( * ) Notice: Subject to any disclaimer, the term of this patent is extended or adjusted under 35 U.S.C. 154(b) by 0 days.

(21) Appl. No.: 17/073,754

(22) Filed: Oct. 19, 2020

(65) Prior Publication Data

US 2021/0187975 A1 Jun. 24, 2021

(30) Foreign Application Priority Data

Dec. 23, 2019 (JP) ..... JP2019-231779

(51) Int. Cl.

*B41J 11/00* (2006.01)
*B41J 11/04* (2006.01)
*B41J 2/32* (2006.01)

(52) U.S. Cl.

CPC ..... *B41J 11/04* (2013.01); *B41J 2/32* (2013.01); *B41J 11/005* (2013.01)

(58) Field of Classification Search

CPC ... B41J 11/04; B41J 2/32; B41J 11/005; B41J 2/325; B41J 25/3088; B41J 11/0055; B41J 13/10; B41J 3/407; B41J 13/12

See application file for complete search history.

(56) References Cited

FOREIGN PATENT DOCUMENTS

| | | | | |
|---|---|---|---|---|
| JP | H05-314326 A | | 11/1993 | |
| JP | H07-271922 A | | 10/1995 | |
| JP | 2695964 | * | 1/1998 | ..... B65H 31/30 |
| JP | 3059587 U | | 7/1999 | |
| JP | 2000-225740 A | | 8/2000 | |
| JP | 2003-312063 A | | 11/2003 | |
| JP | 2007-106076 A | | 4/2007 | |
| JP | 2018-176572 A | | 11/2018 | |

OTHER PUBLICATIONS

Office Action dated Mar. 17, 2020 in corresponding Japanese Application No. 2019-231779; 6 pages; Machine translation attached.

* cited by examiner

*Primary Examiner* — Sharon Polk
(74) *Attorney, Agent, or Firm* — Maier & Maier, PLLC

(57) ABSTRACT

A printer that performs printing for a print region of a glass plate includes a conveying unit that includes a plurality of paired rollers adapted to sandwich both side faces of the plate, brings the paired rollers respectively in contact with the both side faces with an urging force, and conveys the plate only by the plurality of the paired rollers; a printing unit that includes a printhead and a swinging unit adapted to swing the printhead between a printing position and a retracting position and shifts the printhead to the printing position so as to come in contact with the print region by the swinging unit when printing, and performs printing for the print region by the printhead; and a suppressing guide unit that regulates floating-up of the plate when printing by coming in contact with the plate only on a neighborhood region of the side face.

9 Claims, 11 Drawing Sheets

PRINTER

CROSS-REFERENCE TO RELATED APPLICATION

The entire disclosure of Japanese patent application no. 2019-231779, filed on Dec. 23, 2019, is incorporated herein by reference in its entirety.

FIELD

The present invention relates to a printer, and in particular, relates to a printer to perform printing for a plate, such as a preparation slid.

BACKGROUND

Conventionally, a thermal transfer printer has been known that sends out a glass plate positioned at the lowermost stage one sheet by one sheet from a cassette that stores a plurality of glass plates used as a preparation slide and performs printing for the glass plate sent out (for example, refer to JP 2003-312063A).

By using such a cassette that stores a plurality of preparation slides, it is possible to perform printing continuously for a large number of preparation slides. Moreover, at the time of performing this printing, by actuating selectively heating elements of a thermal head while bringing a thermal head in pressure contact with the surface of a glass plate via an ink ribbon existing between the thermal head and the glass plate, ink coated on the ink ribbon is transferred onto the surface of the glass plate, whereby information is drawn as an image.

SUMMARY

However, at the time of performing printing for a plate, such as a glass plate, by a thermal head, since the thermal head is moved downward (head-down) so as to come in contact with the plate, the conveyance of the plate becomes unstable due to the contact with the thermal head. Therefore, there is a problem that print quality is affected.

The present invention has been achieved in view of the above-described circumstances, and an object of the present invention is to provide a printer that performs conveyance of a plate stably.

In order to realize the above-described object, a printer that reflects one aspect of the present invention, is a printer that performs printing for a glass plate provided with a print region and used for a preparation slide, includes: a conveying unit that includes a plurality of paired rollers adapted to sandwich both side faces of the plate in a width direction orthogonal to a conveyance direction of the plate, brings the paired rollers respectively in contact with the both side faces of the sandwiched plate by urging each of the paired rollers with an urging force of an elastic member, and conveys the plate in the conveyance direction by the plurality of the paired rollers while sandwiching the plate by rotating each of the paired rollers with a driving force of a drive motor; a printing unit that includes a printhead and a swinging unit adapted to swing the printhead between a printing position and a retracting position apart from the printing position, shifts the printhead to the printing position by the swinging unit when printing, brings the printhead in contact with the print region on the surface of the plate being conveyed by the conveying unit, and performs printing for the print region by the printhead; and a suppressing guide unit that regulates floating-up of the plate when printing by coming in contact with the plate from a surface side only on a neighborhood region of the side face so as not to come in contact with an observation region at a center in the width direction of the plate on a surface of the plate being conveyed by the conveying unit.

In order to realize the above-mentioned object, a printer that reflects one aspect of the present invention, is a printer that performs printing for a glass plate provided with a print region and used for a preparation slide, includes: a conveying unit that includes a plurality of paired rollers adapted to sandwich both side faces of the plate in a width direction orthogonal to a conveyance direction of the plate, brings the paired rollers respectively in contact with the both side faces of the sandwiched plate by urging each of the paired rollers with an urging force of an elastic member, and conveys the plate in the conveyance direction by the plurality of the paired rollers while sandwiching the plate by rotating each of the paired rollers with a driving force of a drive motor; a printing unit that performs printing for the print region on a surface of the plate being conveyed by the conveying unit at a printing position; a stacker that is disposed on an outside of a discharge port through which the plate having been printed is discharged and stacks the discharged plate; and a suppressing guide unit that is disposed between the discharge port and the printing position and regulates floating-up of the plate when discharging by coming in contact with the plate from a surface side only on a neighborhood region of the side face so as not to come in contact with an observation region at a center in the width direction of the plate on a surface of the plate being conveyed by the conveying unit.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
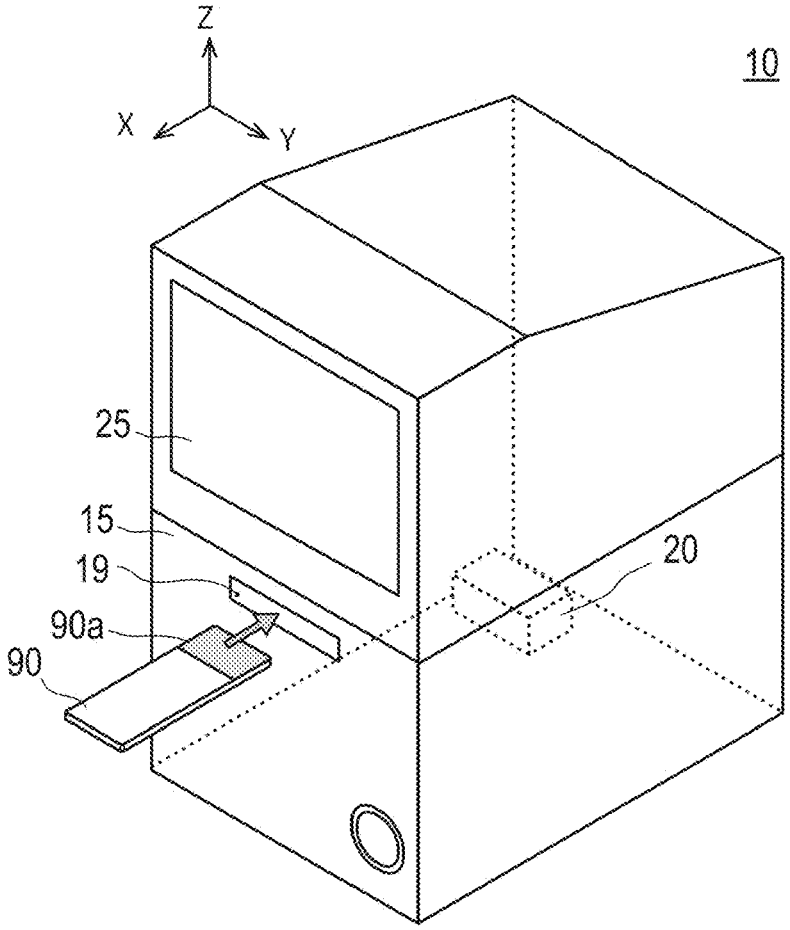
FIG. 1 is a perspective view showing an outer appearance of a printer according to the embodiment of the present invention.

Hereinafter, with reference to attached drawings, an embodiment of the present invention will be described. In this connection, in the description for the drawings, the same element is provided with the same reference symbol, and the overlapping description is omitted. Moreover, dimensional ratios in the drawings are exaggerated on account of description and may be different from the actual ratios.

Figure 2:
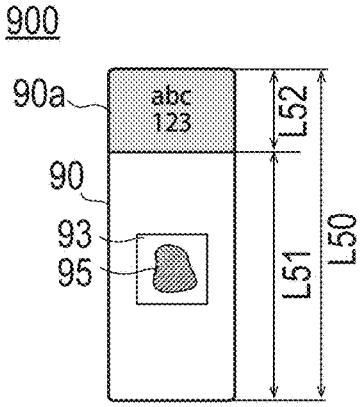
FIG. 2 is a drawing showing a plate for a preparation slide.
Figure 3:
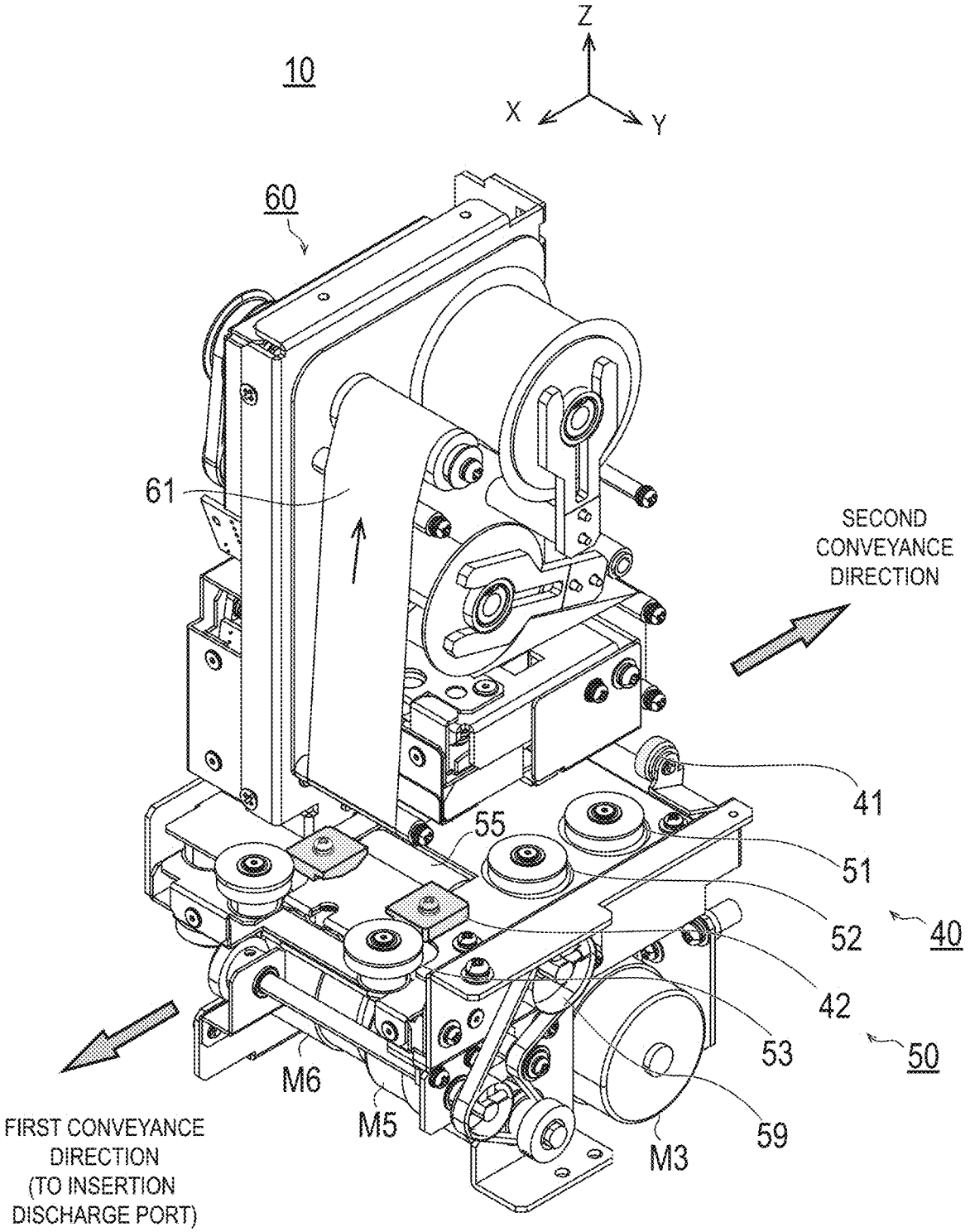
FIG. 3 is a perspective view showing an internal configuration of the whole body of a printer according to the present embodiment.

FIG. 1 is a drawing showing an outer appearance of a printer 10 according to an embodiment of the present invention. FIG. 2 is a drawing showing a plate 90 for a preparation slide as a specific example of a plate to be printed by the printer 10. FIG. 3 is a perspective view of the whole body of the printer 10 according to the present embodiment. Hereinafter, in the attached drawings, up and down directions are referred to as a Z direction, front and back directions in the printer are referred to as an X direction, and a direction orthogonal to these X and Z directions is referred to as a Y direction. Moreover, hereinafter, in the case where there is no special description, the conveyance direction of the plate 90 is the X direction, and a width direction is the Y direction. Moreover, as shown with an arrow mark in FIG. 3, a direction toward an insertion discharge port among the conveyance directions is specifically referred to as "a first conveyance direction", and a direction opposite to this direction is referred to as "a second conveyance direction".

(Configuration of Whole Body of Printer 10)

In the case of referring to FIG. 1 and FIG. 3, the printer 10 includes a control unit 20, a suppressing guide unit 40, a conveying unit 50, and a printing unit 60. The control unit 20 includes a CPU, a RAM, a ROM, an auxiliary memory, and the like and performs control for the whole body of the printer 10. On an apparatus front-face side of an exterior casing 15 of the printer 10, there is provided a discharge port 19 through which the plate 90 is inserted and discharged. In the printer 10, the control unit 20 controls each constitution component, whereby the printing unit 60 performs printing for the surface of a plate 90 inserted by a user from the discharge port 19.

As shown in FIG. 1, on the front face side of the printer 10, there is further provided a display unit 25 that performs the displaying of a mode state and various kinds of data and the inputting of settings. In the display unit 25, there is adopted a liquid crystal display, an organic EL (Electro-Luminescence) display, or the like in which a touch panel is superimposed.

As shown in FIG. 2, the plate 90 as a print medium used in the present embodiment is a rigid body, for example, is a glass plate for a preparation slide. In the plate 90, the sizes of one sheet are, for example, 25 mm in width, 75 mm in overall length, and 1.0 mm in thickness. On the plate 90, an observation sample 95 is pasted and pressed down with a cover glass 93, whereby a preparation slide 900 to be observed with a microscope etc. is produced. Among the plates 90, there is one provided with "a print region" referred to as a so-called frosted portion 90*a* on over a some region of its one surface, and the print region is processed such that information, such as characters and bar codes, indicating administration numbers, date, memo, and the like of the observation sample 95 is easily recorded with writing tools and the like. In the present embodiment, a frosted portion 90*a* of the plate 90 corresponds to the print region, and the printing unit 60 performs printing onto this print region. The size and position of the frosted portion 90*a* may be caused to be memorized by a memory unit of the control unit 20 in advance or may be caused to be input appropriately by a user through the display unit 25 and the like. This frosted portion 90*a* is disposed on one end portion or in the vicinity of one end portion of the plate 90. For example, in accordance with settings, a user sets this print region side of a plate 90 to a leading end side and inserts the plate 90 from the discharge port 19.

Modified Example

Figure 4:
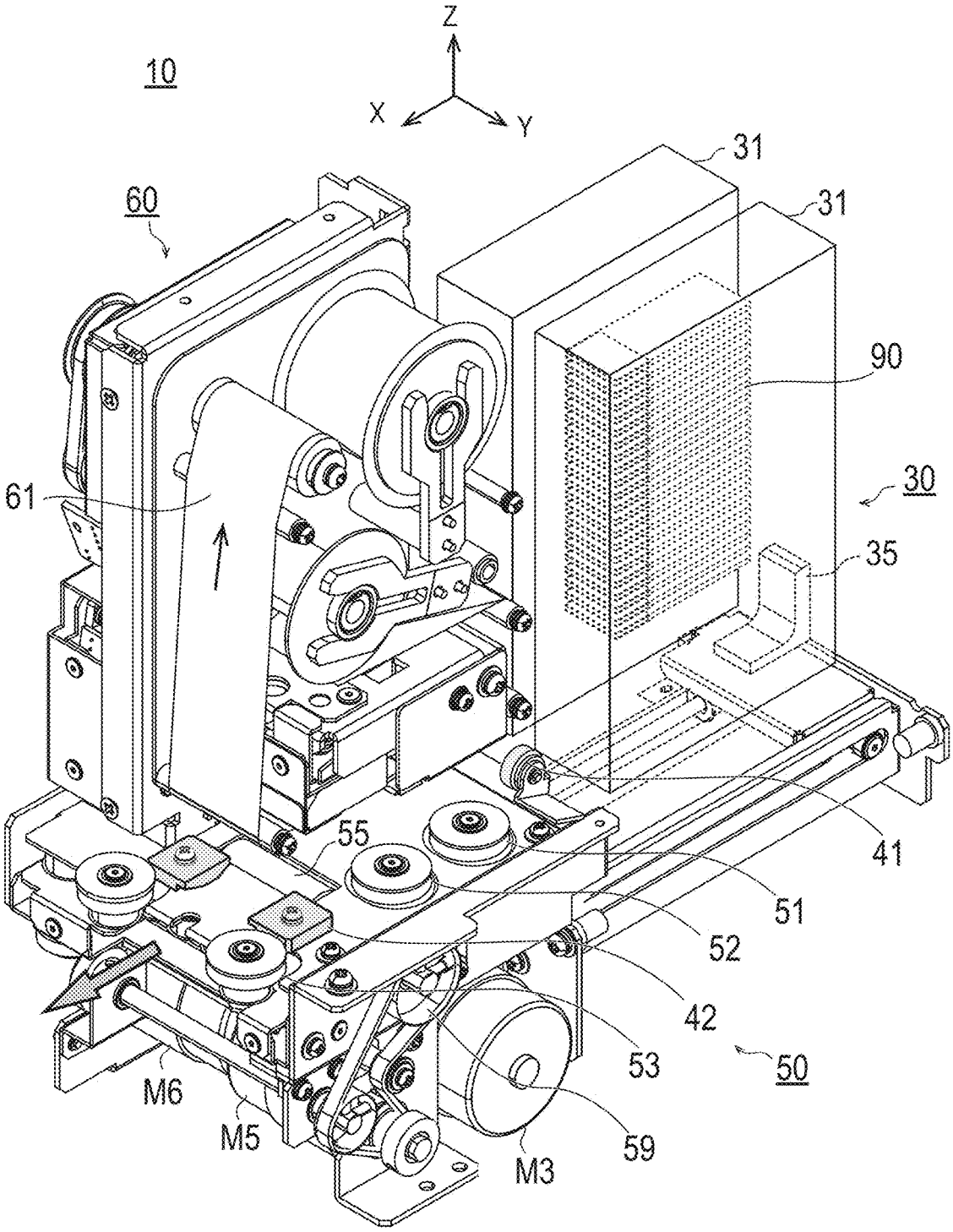
FIG. 4 is a perspective view showing an internal configuration of the whole body of a printer to which a cassette is attached.
Figure 5:
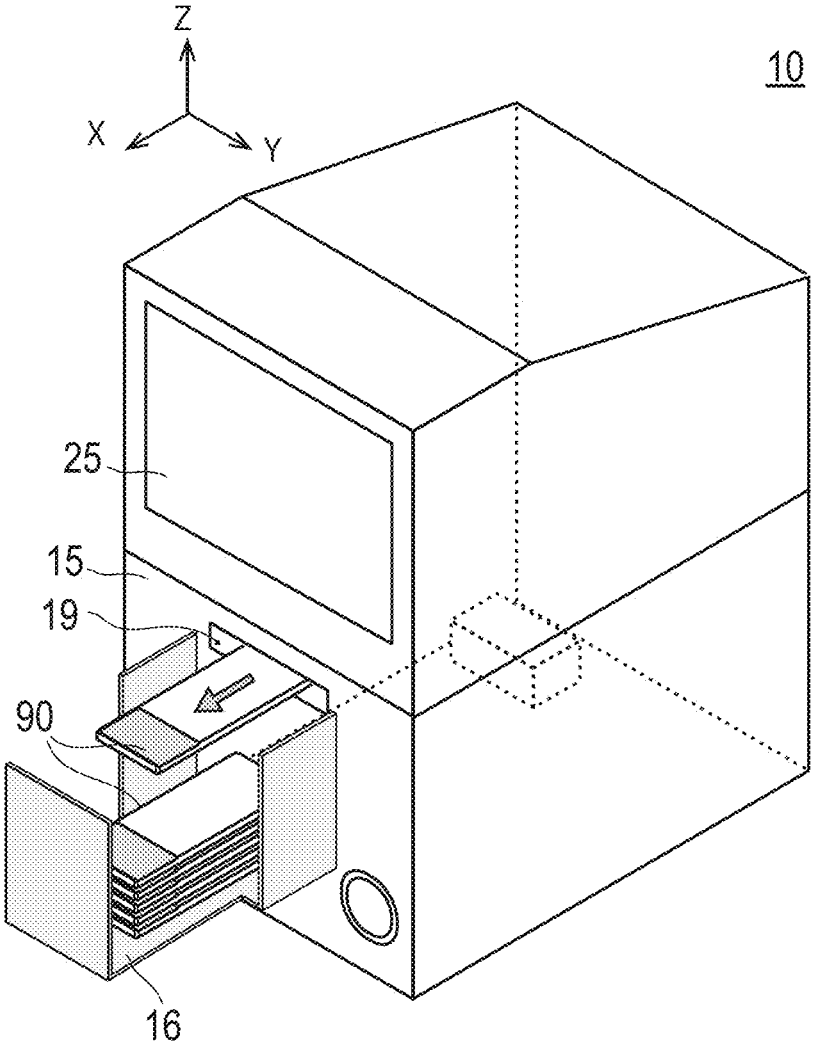
FIG. 5 is a perspective view showing an outer appearance of a printer to which a stacker is attached.

Next, with reference to FIG. 4 and FIG. 5, a configuration of the printer 10 according to a modified example will be described. FIG. 4 is a perspective view showing an internal configuration of the whole body of the printer 10 to which a cassette 31 is attached, and FIG. 5 is a perspective view showing an outer appearance of the printer 10 to which a stacker 16 is attached. The stacker 16 is attached to the lower side of the discharge port 19 of the exterior casing 15. The cassette 31 is also referred to as a cartridge and, for example, is made of metal. The printer 10 of the modified example in FIG. 4 further includes a supplying unit 30. The supplying unit 30 includes a plurality of cassettes 31 and a claw member 35. When the claw member 35 is driven in the first conveyance direction with a drive motor M3, the claw member 35 supplies a plate 90 at the lowermost stage one by one continuously among the plurality of plates 90 stored in the cassette 31. When pushing out the plate 90 in the first conveyance direction, the claw member 35 comes in contact with a side face, on the back-end side, of the plate 90. After the plate 90 at the lowermost stage has been sent out, a plate 90 that locates at an upper position and will come to the lowermost stage at the next, falls to a prescribed position regulated by a stopper (not shown). When the claw member 35 has arrived up to a movement terminal end in the first conveyance direction, the claw member 35 is configured to be shifted downward slightly in the Z direction with a link mechanism (not shown). Successively, in a state of having been shifted downward, the claw member 35 returns up to a movement terminal end (initial position) in the second conveyance direction of the reverse direction. By being shifted downward, at the time of returning, the surface (undersurface) of the plate 90 and the claw member 35 become in non-contact with each other, thereby preventing contamination such as adhesion of foreign matter to the plate 90 due to the claw member 35.

The printer 10 includes a drive mechanism (not shown) that makes the two cassettes 31 move in a width direction. Upon having used up the plates 90 of one cassette 31 having been set at the supply position among the two cassettes 31, the one cassette 31 is made to slide in the Y direction with a drive mechanism, and the other cassette 31 is set at the supply position.

Thereafter, the supplying of the plates 90 is resumed from the other cassette 31 having been set at the supply position.

Moreover, the print region (frosted portion 90*a*) of each of the plates 90 supplied continuously is printed by the printing unit 60, and then, the plates 90 are discharged one by one from the discharge port 19 so as to drop into the stacker 16 and are stacked (placed) in the stacker 16. In this connection, in the printer 10 according to the modified example, the configuration other than the supplying unit 30 and the stacker 16 is the same as the configuration in the printer 10 shown in FIG. 1 and FIG. 3.

(Conveying Unit 50)

Next, with reference to FIG. 6 through FIG. 9B, the suppressing guide unit 40 and the conveying unit 50 will be described. First, the conveying unit 50 will be described, and then, the suppressing guide unit 40 will be described.

Figure 6:
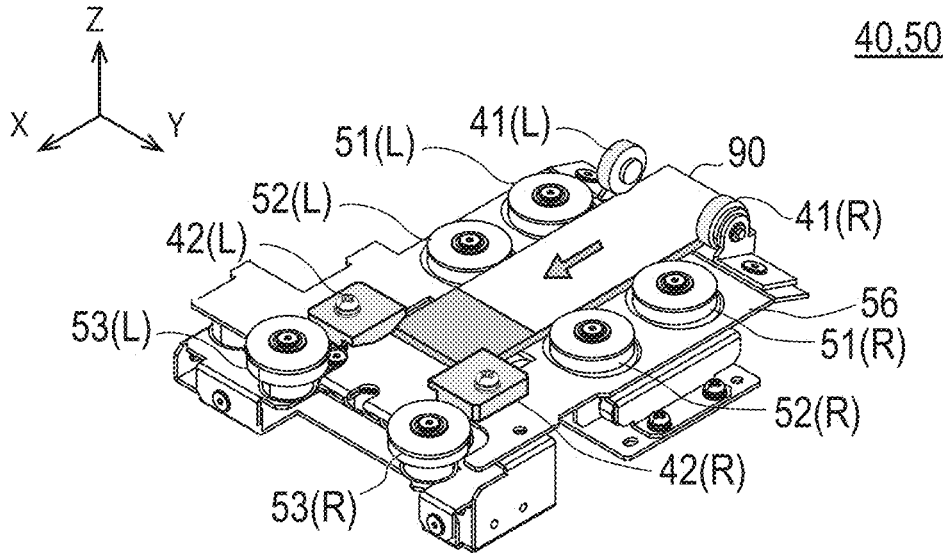
FIG. 6 is a perspective view showing a configuration of a conveying unit and a suppressing guide unit.
Figure 7A:
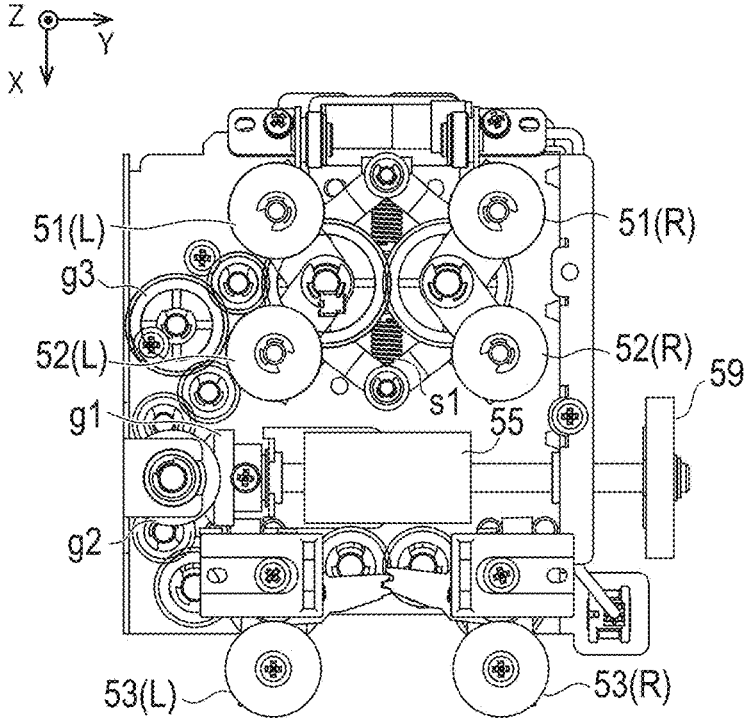
FIG. 7A is a top view showing a configuration of a driving mechanism of a conveying unit.
Figure 7B:
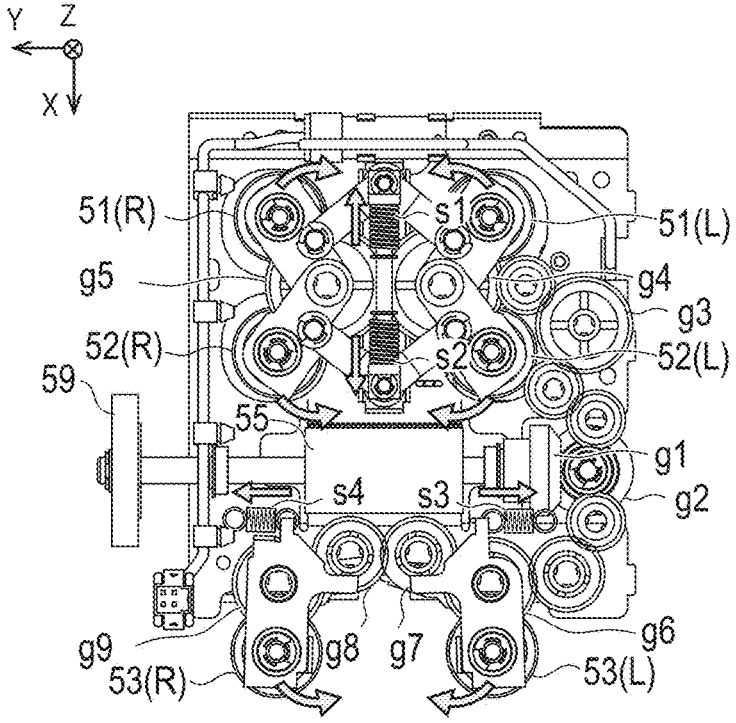
FIG. 7B is a bottom view showing a configuration of a driving mechanism of a conveying unit.
Figure 8:
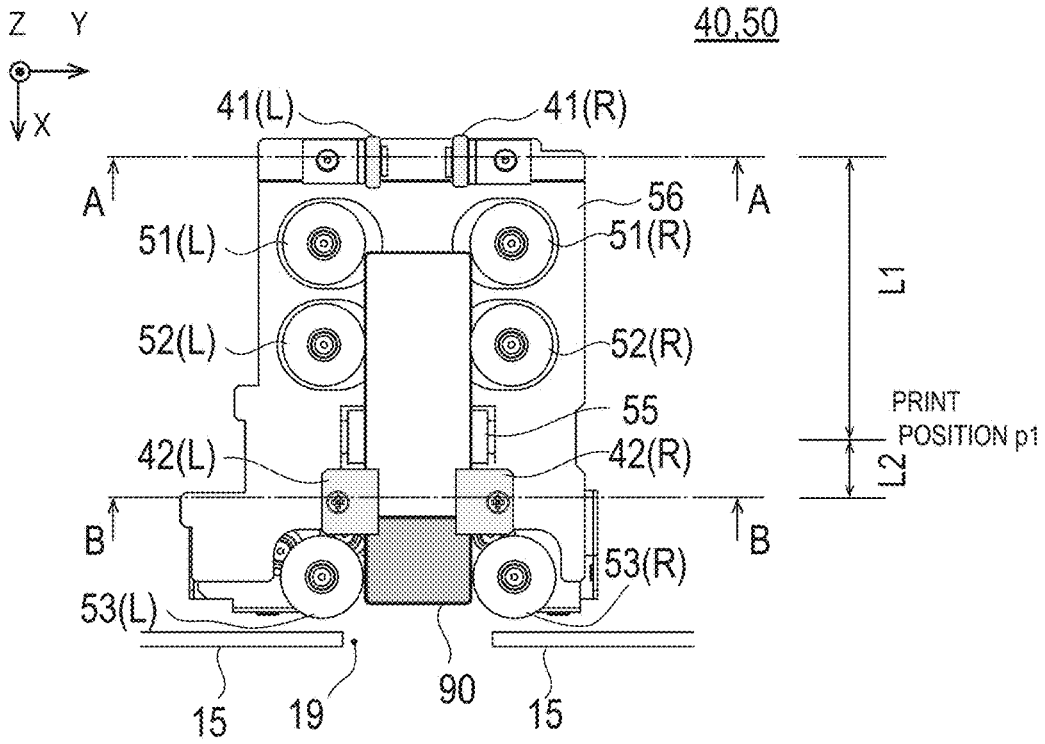
FIG. 8 is a top view showing a configuration of a conveying unit and a suppressing guide unit.

FIG. 6 is a perspective view showing a configuration in the vicinity of the conveying unit 50. FIG. 7A is a top view showing a configuration of a driving mechanism of the conveying unit 50, and FIG. 7B is a bottom view showing the same configuration as that in FIG. 7A. FIG. 8 is a top view showing a configuration in the vicinity of the conveying unit 50.

As shown in these figures, the conveying unit 50 includes conveying rollers 51, 52, and 53 that sandwich and hold the plate 90 from both sides in the width direction, a platen roller 55, a guide plate 56, a drive motor M5 (refer to FIG. 3), a pulley 59, gears g1 to g9, and the like. The pulley 59 and the gear g2 make a rotation shaft common, and to this rotation shaft, the platen roller 55 is attached. The platen roller 55 is disposed so as to oppose the printing unit 60 (printhead), and the center of the platen roller 55 is designed so as to overlap with a printing position p1 in the conveyance direction.

As shown in FIG. 7A and FIG. 7B, the driving force of the drive motor M5 is transmitted to the pulley 59 and the gear g1 in this order through a driving belt (refer to FIG. 3 and FIG. 4). The conveying roller 51 includes one pair of right and left rollers 51(R) and 51(L) (also referred to as one set of paired right and left rollers 51(R) and 51(L)). The two rollers (paired rollers), i.e., one pair of the right and left rollers 51(R) and 51(L) come respectively in contact with both side surfaces, in the width direction, of the plate 90 so as to sandwich and hold the plate 90 and convey the plate 90 along the top surface of the guide plate 56. The one pair of these rollers 51(R) and 51(L) are urged inward toward each other with elastic members (below-mentioned springs s1 and s2) and suppress both side surfaces of the plate 90 between them with the urging force. Similarly, each of the conveying rollers 52 and 53 also includes one pair of right and left rollers. As being like the modified example, in the case of supplying the plate 90 from the cassette 31, these conveying rollers 51, 52, and 53 are rotates in one direction with the drive motor M5 so as to move the plate 90 in the first conveyance direction. Moreover, as being like the embodiment shown in FIG. 1 and FIG. 3, in the case of supplying the plate 90 through the discharge port 19 by front loading and discharging the plate 90 from the discharge port 19, these conveying rollers 51, 52, and 53 are rotated in the normal direction and the reverse direction with the drive motor M5 under the control of the control unit 20.

As shown in FIG. 7A and FIG. 7B, the right and left rollers of each of the conveying rollers 51, 52, and 53 are linked via a plurality of gears g2 to g9 and the like. The driving force of the drive motor M5 is transmitted from the upstream-side gear g2 that shares the rotation shaft with the pulley 59 to each of the conveying rollers 51 to 53 via the plurality of gears g3 to g9. By the one drive motor M5, together with the above-mentioned platen roller 55, three pairs of conveying rollers 51 to 53 are driven synchronously. In this connection, the paired rollers of each of the conveying rollers 51 to 53 come respectively in contact with the side faces of the plate 90 with the urging force acting toward an inner side as mentioned later and convey the plate 90 in the conveyance direction while sandwiching and holding the plate 90 between them. At this time, the conveying of the plate 90 may be performed only by the paired rollers of each of the plurality of conveying rollers 51 to 53.

In concrete terms, in the conveying rollers 51 and 52, the driving force transmitted to the gear g2 is transmitted to the roller 51(L) and 52(L) via the gear series constituted with a plurality of gears including the downstream-side gear g3 and gear g4. Moreover, the driving force transmitted to the gear g4 is further transmitted to the roller 51(R) and 52(R) via the downstream-side gear g5 linked to the gear g4.

Similarly, in the conveying roller 53, the driving force transmitted to the gear g2 is transmitted to the roller 53(L) via the gear series constituted with a plurality of gears including the downstream-side gear g6. Moreover, the driving force transmitted to the gear g6 is further transmitted to the roller 53(R) via the downstream-side gears g7 to g9.

Moreover, the conveying unit 50 includes the springs s1 to s4 as an elastic member. At least one of respective rotating shafts of right-side (R-side) or left-side (L-side) rollers constituting each of the conveying rollers 51 to 53, is configured to be movable in the width direction (Y direction) within a prescribed range. The springs s1 and s2 are compression springs, and their elastic forces (refer to straight line-shaped arrow marks) are transmitted to each of the rollers 51(L), 51(R), 52(L), and 52(R) via arms and become urging forces toward inner sides in the width direction (refer to arc-shaped arrow marks). Moreover, the springs s3 and s4 are tension springs, and their elastic forces (refer to straight line-shaped arrow marks) are transmitted to each of the rollers 53(L) and 53(R) via arms and become urging forces toward inner sides in the width direction (refer to arc-shaped arrow marks).

The conveying unit 50 includes a plurality of paired rollers adapted to sandwich both side faces of the plate in a width direction orthogonal to a conveyance direction of the plate, brings the paired rollers respectively in contact with the both side faces of the sandwiched plate by urging each of the paired rollers with an urging force of an elastic member, and conveys the plate in the conveyance direction by the plurality of the paired rollers while sandwiching the plate by rotating each of the paired rollers with a driving force of a drive motor. By providing the conveying unit 50 with such a configuration, in response to the movement of the plate 90 being inserted while opposing the elastic forces of the springs s1 to s4, the paired rollers of each of the rollers 51 to 53 retracts to the outside (in the arrow mark direction in the above drawings). By having such a configuration, the paired rollers, i.e., one pair of rollers 51(L) and 51(R) retract to the outside in the width direction in response to the width of the plate 90 having been inserted between them. In addition, by rotating while urging the plate 90 toward the inside (the center side between both rollers), the paired rollers 51(L) and 51(R) convey the plate 90 in the conveyance direction while sandwiching and holding the plate 90 between them. Similarly, by rotating while urging the plate 90 toward the inside, the paired rollers 52(L) and 52(R) and the paired rollers 53(L) and 53(R) also convey the plate 90 in the conveyance direction while sandwiching and holding the plate 90 between them. By having such a configuration, it is possible to drive three sets of paired rollers 51(R) and 51(L), 52(R) and 52(L), and 53(R) and 53(L) with the one drive motor M5, and, in addition, it is possible to convey the plate 90 stably while suppressing it with the urging forces of the springs s1 to s4.

(Suppressing Guide Unit 40)

As shown in FIG. 6, FIG. 8, and the like, the suppressing guide unit 40 is disposed on a conveyance passage. The suppressing guide unit 40 includes a suppressing roller 41 and a plate member 42. The suppressing guide unit 40 has a function to regulate the floating-up of a plate by coming in contact with the plate 90 from the surface side of the plate 90 (coming in contact with the top surface of the plate 90). The suppressing roller 41 includes one pair of right and left rollers 41(R) and 41(L). Similarly, the plate member 42 includes one pair of right and left plate members 42(R) and 42(L). These rollers and plate members come in contact with the plate 90 from the surface side of the plate 90 on the respective neighborhood regions of the side faces (width-direction side faces) of the plate 90.

Figure 9A:
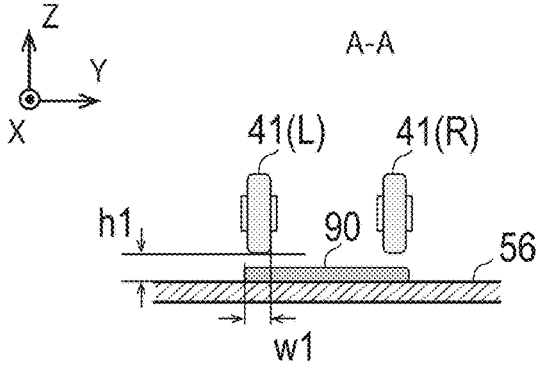
FIG. 9A is a schematic drawing for describing a configuration of a suppressing guide unit.
Figure 9B:
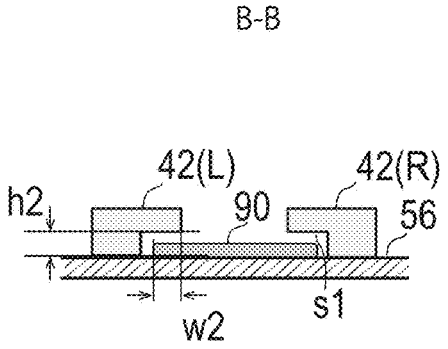
FIG. 9B is a schematic drawing for describing a configuration of a suppressing guide unit.

FIG. 9A and FIG. 9B are schematic drawings for describing a configuration of the suppressing guide unit 40, FIG. 9A is an A-A cross-sectional view in FIG. 8, and FIG. 9B is a B-B cross-sectional view in FIG. 8.

As shown in FIG. 9A, two rollers 41(R) and 41(L) of one pair of the suppressing rollers 41 are supported rotatably around an axis that extends in the Y direction and serves as a rotation center. Accordingly, when the outer peripheral surface of the suppressing roller 41 comes in contact with the surface of the floated-up plate 90, the suppressing roller 41 rotates freely (rotate while following the movement of the plate 90). The material of the roller is, for example, polyacetal (POM). On the neighborhood region of the side face (width-direction side face) on the surface of the plate 90, the suppressing roller 41 comes in contact with the plate 90 from the surface side of the plate 90. It is preferable that a range that the suppressing roller 41 comes in contact with the plate 90 in the width direction, is set so as to avoid the pasted region of the cover glass 93 such that contamination (attached substances) caused by coming of the suppressing guide unit 40 in contact with the surface of the plate 90 does not influence the observation sample 95. With regard to this range that the suppressing roller 41 comes in contact with the plate 90, that is, a distance w1 from the side face of the plate 90 to be conveyed, to the side end portion, at the center side, of the suppressing roller 41, in the case where the range is, for example, a region corresponding to 6% or less relative to the total width from each of both ends of the plate 90 and the width of the plate 90 is, for example, 25 mm, the distance w1 is set to 1.5 mm or less. Moreover, the height of the undersurface of the suppressing roller 41, that is, the height h1 (distance in the Z direction) from the top face of the guide plate 56 to the undersurface of the suppressing roller 41 is set appropriately depending on the inclination angle of the plate 90 permissible at the time of printing. For example, the height h1 is 1.8 mm.

Similarly, as shown in FIG. 9B, two plate members 42(R) and 42(L) of the one pair of plate members 42 also come in contact with the plate 90 from the surface side of the plate 90 on the respective neighborhood regions of side faces (width-direction side faces) on the surface of the plate 90. The undersurface S1 of the plate member 42 includes a surface parallel to an XY flat surface, and this undersurface comes in contact with the surface of the floated-up plate 90. The distance w2 is set, for example, to 1.5 mm, and the height h2 is set to 1.9 mm.

As shown in FIG. 8, a distance L1 from a printing position p1 to the suppressing roller 41 (center) in the conveyance direction is, for example, 60.7 mm, and a distance L2 from the printing position p1 to the plate member 42 (center) is, for example, 17.5 mm. The distances L1 and L2 are set appropriately in consideration of the overall length of the plate 90 to be used, a range of a print region (frosted portion 90*a*), and the insertion direction of the plate 90. For example, the distance L1 is shorter than the overall length LSO (refer to FIG. 2) of the plate 90 to be used as standard and, more preferably, is shorter than a distance L51 (refer to FIG. 2) from an end portion, on the center side, of the print region to an end face, on a far side, of the plate 90. The distance L2 is shorter than the overall length of the plate 90 to be used as standard, and, more preferably, is shorter than a distance L52 (refer to FIG. 2) from an end portion, on the center side, of the print region to an end face, on a near side, of the plate 90. Moreover, the distance L2 is shorter than the distance L1. In this connection, the printing position p1 is, strictly speaking, a later-mentioned contact position at which the printing unit 60 (printhead 621) comes in contact with the plate 90. However, in here, the position of the center axis of the platen roller 55 in the X direction is used as the printing position p1.

Even if the inclination angle of the plate 90 is the same, as a distance is longer, an amount of floating-up becomes larger. Since the distance L1 of the suppressing roller 41 is longer than the distance L2 of the plate member 42, in the case of the same inclination angle, an amount of floating-up of an end portion becomes larger. Therefore, it is preferable that the height h1 of the undersurface of the suppressing roller 41 is set higher than the height h2 of the undersurface of the plate member 42. Moreover, as a suppressing member, a roller (suppressing roller 41) is used on a far side, and a plate member (plate member 42) is used on a near side. The reason why a roller is used on a far side is as follows. That is, when the plate 90 is conveyed and moved, an edge of the plate 90 may collide. At that time, the surface of a member may be scratched, or the glass fiber of the plate 90 adheres (stick in) to the surface. Accordingly, the roller is used to prevent the above problems.

(Printing Unit 60)

Figure 10:
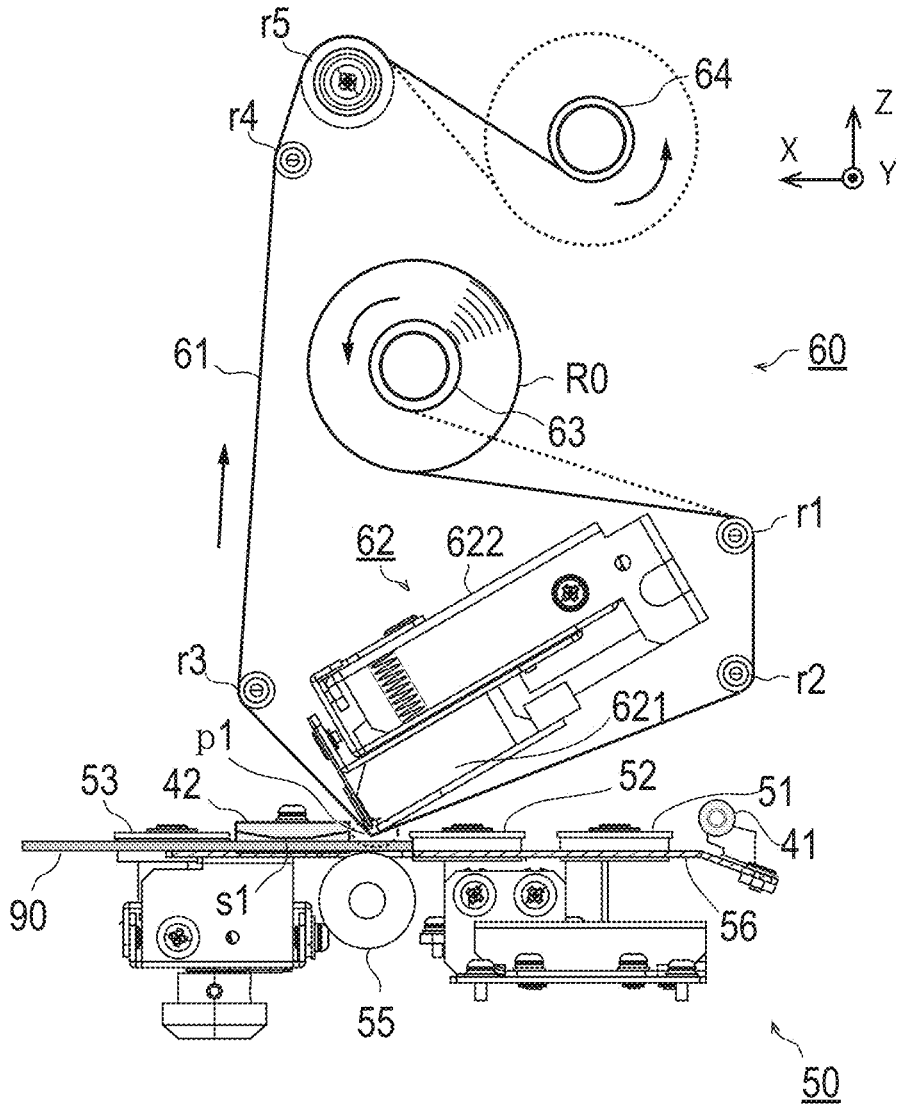
FIG. 10 is a side view showing a configuration of a conveying unit and a printing unit.

Next, with reference to FIG. 10, a configuration of the printing unit 60 will be described. FIG. 10 is a side view showing a configuration of the conveying unit 50 and the printing unit 60. As shown in FIG. 10, the printing unit 60 includes a thermal transfer unit 62 that transfers ink of an ink ribbon 61 onto the plate 90, an ink ribbon supplying unit 63 that holds a source roll RO of a roll-shaped ink ribbon and performs unwinding of the ink ribbon 61, an ink ribbon winding-up unit 64 that winds up the ink ribbon 61, and a drive motor M6 (refer to FIG. 3 and the like) that drives these units.

The ink ribbon 61 is conveyed in a state of being stretched over a plurality of support rollers r1 to r5. The ink ribbon 61 includes at least a substrate layer and an ink layer coated on this substrate layer. The ink ribbon 61 is wound out from the source roll RO and transfers ink corresponding to print data in response to the operation of the thermal transfer unit 62 at a printing position p1 corresponding to the platen roller 55. In this connection, at the time of performing printing, printing processing is performed while moving the plate 90 in the first conveyance direction (refer to FIG. 3) so as to match with the conveyance direction of the ink ribbon 61. For example, in the case of front loading, the plate 90 is conveyed in the second conveyance direction until the whole portion of a print region has passed over the printing position p1, and thereafter, the conveyance direction is switched to the first conveyance direction, and then, the printing processing including head-down is started.

The thermal transfer unit 62 includes a printhead 621 and a swinging unit 622. This printhead 621 is also referred to as a thermal head and is swung by the swinging unit 622 between a retracting position (refer to FIG. 3, FIG. 13 and the like) and a printing position p1 (refer to FIG. 10). At the time of transferring ink, the printhead 621 is shifted from the retracting position to the printing position p1 where the printhead 621 is brought toward the platen roller 55 so as to come in pressure contact with the platen roller 55 through the plate 90. The printhead 621 includes a plurality of minute heating elements. In the printing position p1 in FIG. 10, the printhead 621 comes in contact (pressure contact) with the surface of the plate 90 being conveyed, via the ink ribbon 61. The contacting position becomes the printing position p1, and this printing position p1 coincides, in view of design, with the center position (X direction) of the platen roller 55 on the surface of the plate 90 with a standard thickness. In the state where the printhead 621 and the ink ribbon 61 locate at the printing position p1, by making an electric current flow into the heating elements of the printhead 621 selectively correspondingly to image data so as to generate heat locally, some of ink of the locally-heated ink ribbon 61 is transferred locally onto the surface of the plate 90, whereby an image is formed on the surface.

(Fluctuation of Plate 90 at Time of being Conveyed and Function of Suppressing Guide Unit 40)

Next, with reference to FIG. 11A through FIG. 13, the fluctuation of the plate 90 at the time of being conveyed and the function of the suppressing guide unit 40 in the present embodiment will be described.

(With Regard to Inclination of Plate 90 at Time of being Printed)

FIGS. 11A and 11B and FIGS. 12A and 12B are schematic diagrams for describing a suppressing function against the plate 90 at the time of printing. As mentioned above, the center of the platen roller 55 is designed so as to coincide with a contact position (printing position p1) by the printhead 621 in the conveyance direction (the X direction). However, due to dispersion in design or a difference in the thickness of the plate 90 to be used, the center of the platen roller 55 may slightly deviate from the contact position.

Figure 11A:
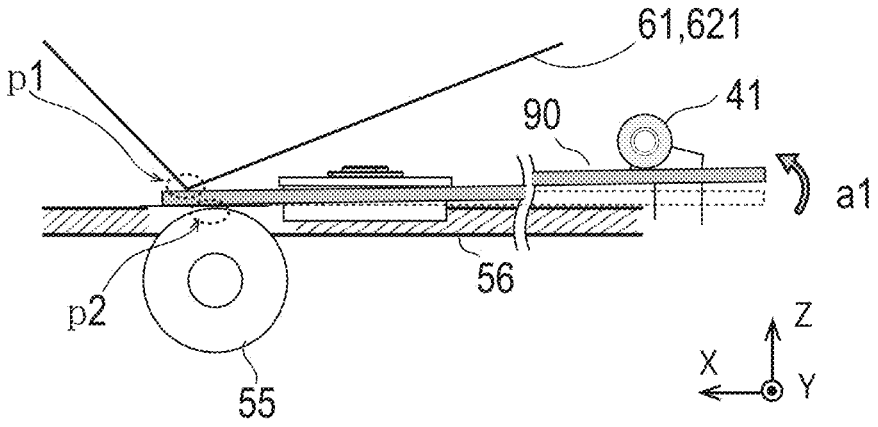
FIG. 11A is a schematic drawing for describing a suppressing function against a plate at the time of printing.
Figure 11B:
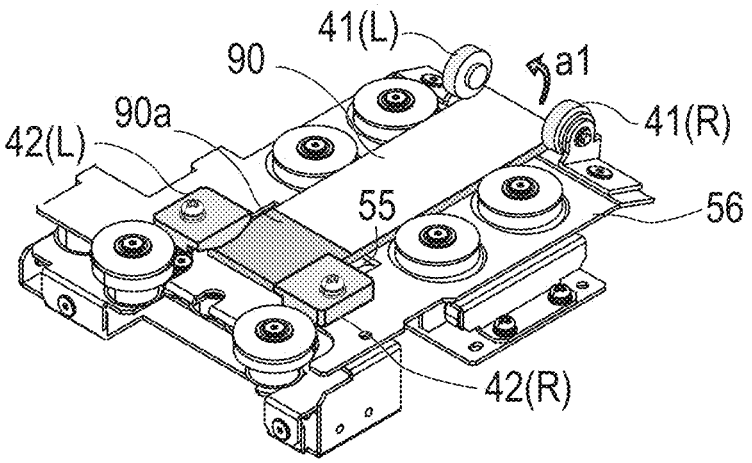
FIG. 11B is a schematic drawing for describing a suppressing function against a plate at the time of printing.

FIGS. 11A and 11B are drawings showing a state in the case where the printing position p1 deviates from the center position p2 of the platen roller 55 to a downstream side (the left side in the drawing) in the conveyance direction. In this case, at the time of the head down of the printhead 621, pressing force acts on the printing position p1 by the printhead 621. Accordingly, due to the pressing force, the back end of the plate 90 tries to float up in the direction of an arrow mark a1 around the center position p2 serving as a fulcrum. In this case, the undersurface of the suppressing roller 41 disposed on the back end side of the plate 90, i.e., on the upstream side in the conveyance direction comes in contact with the plate 90, whereby the position of the plate 90 is regulated. By the suppressing roller 41, the inclination of the plate 90 is prevented from changing more than the predetermined inclination. As a result, at the time of printing operation, the angle of the plate 90 is stabilized, whereby printing can be performed precisely.

Figure 12A:
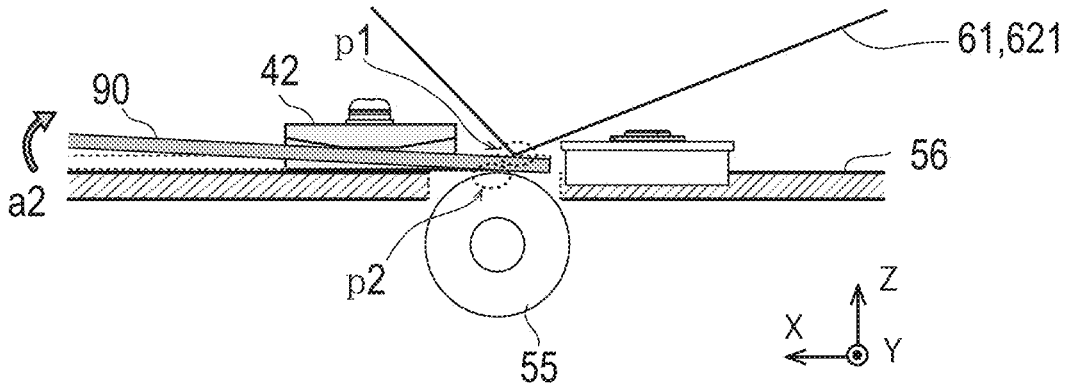
FIG. 12A is a schematic drawing for describing a suppressing function against a plate at the time of printing.
Figure 12B:
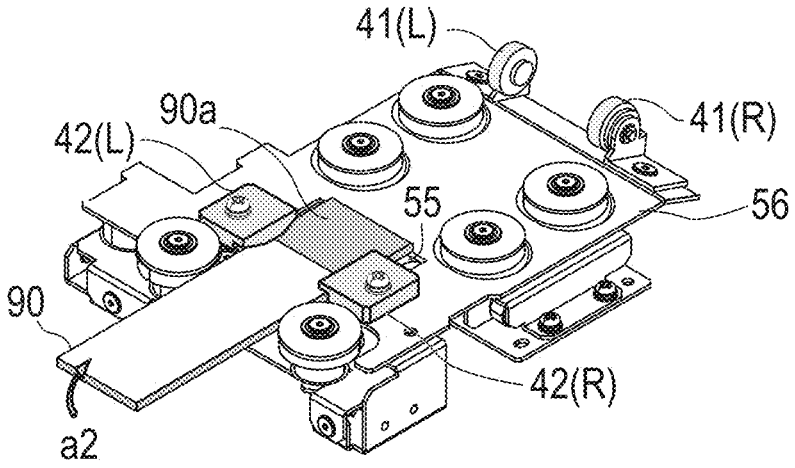
FIG. 12B is a schematic drawing for describing a suppressing function against a plate at the time of printing.

FIGS. 12A and 12B are drawings showing a state in the case where the printing position p1 deviates from the center position p2 of the platen roller 55 to an upstream side (the right side in the drawing) in the conveyance direction. In this case, a force acts on the printing position p1 by the pressing force of the printhead 621. Accordingly, due to this force, the tip end of the plate 90 tries to float up in the direction of an arrow mark a2 around the center position p2 serving as a fulcrum. In this case, the undersurface of the plate member 42 disposed on the tip end side of the plate 90, i.e., on the downstream side in the conveyance direction comes in contact with the plate 90, whereby the position of the plate 90 is regulated. Similar to FIGS. 11A and 11B, By the plate member 42, the inclination of the plate 90 is prevented from changing more than a predetermined inclination. As a result, at the time of a printing operation, the angle of the plate 90 is stabilized, whereby printing can be performed precisely.

(With Regard to Inclination of Plate 90 at Time of being Discharged)

Figure 13:
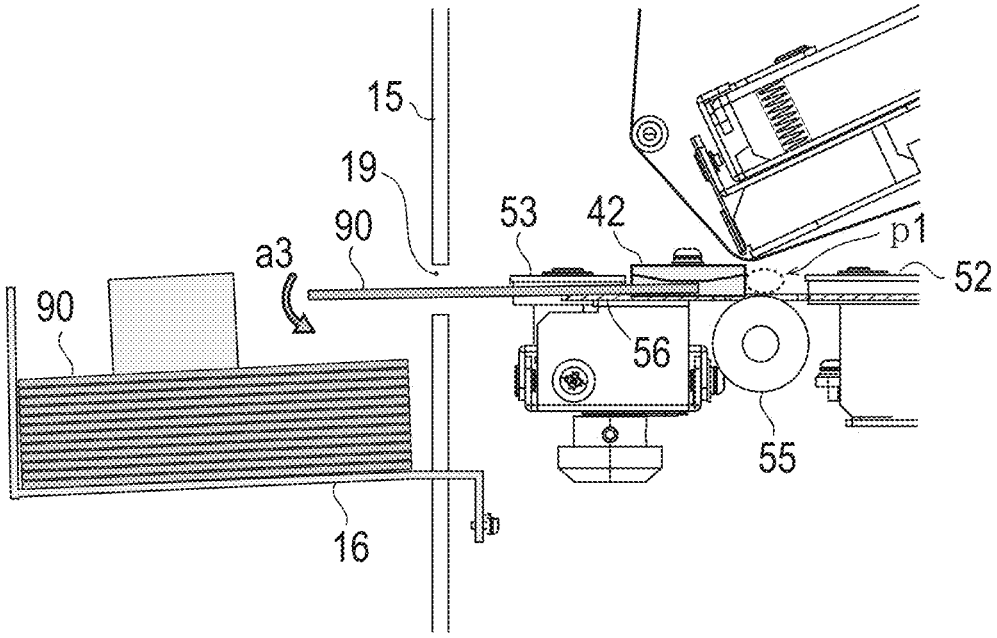
FIG. 13 is a schematic drawing for describing a suppressing function against a plate at the time of discharging.

FIG. 13 is a schematic diagram for describing a suppressing function against the plate 90 at the time of discharging. As shown in FIG. 13, at the time of discharging, the printhead 621 locates at the retracting position, and the plate 90 is conveyed in the first conveyance direction. After having passed over the conveying roller 52, the plate 90 is conveyed while being sandwiched and held only by the conveying roller 53. At this time, if there is not provided any suppressing member, the plate 90 becomes a state of being supported at its only one side by the conveying roller 53. Accordingly, after that, when the gravity center of the plate 90 has passed over the guide plate 56, the plate 90 inclines diagonally due to its own weight, and then, when the inclination becomes large (in the direction of an arrow mark a3), the plate 90 will fall as it is. In the present embodiment, between the discharge port 19 and the print position p1, the plate member 42 of the suppressing guide unit 40 is disposed. Moreover, between the plate members 42 and the discharge port 19, the conveying rollers 53 are disposed as one pair of conveying members. With this, at the time of discharging, even if the plate 90 tries to incline in the arrow mark a3 direction due to its own weight, the floating-up of the back end side is regulated by the plate members 42. As a result, since it is possible to suppress deflection at the time of discharging, the plate 90 can be discharged stably. In particular, in the case of discharging the plate 90 into the stacker 16, a plurality of plates 90 can be stacked in the stacker 16 in a state of being aligned.

In this way, the printer 10 in the present embodiment includes the printing unit 60 that shifts the printhead 621 to the print position p1 by the swinging unit 622 at the time of performing printing, further makes the printhead 621 come in contact with the print region of the surface of the plate 90 being conveyed by the conveying unit 50, and performs printing for the print region with the printhead 621, and the suppressing guide 40 that regulates floating up of the plate 90 at the time of printing by coming in contact with the plate 90 from its surface side on the neighborhood region of the side face of the plate 90 being conveyed by the conveying unit 50. With this, it is possible to perform the conveyance of the plate 90 stably, and as a result, it is possible to perform printing with high quality.

Moreover, the printer according to the present invention includes the suppressing guide unit 40 that is disposed between the discharging port 19 and the printing position p1 and regulates floating up of the plate 90 at the time of discharging by coming in contact with the plate 90 from its surface side on a neighborhood region of the side face of the plate 90 being conveyed by the conveying unit 50. With this, it is possible to perform the conveyance of the plate 90 stably, and as a result, it is possible to perform discharging stably.

With regard to the configuration of the printer 10 having been described in the above, in order to describe the features of the above-described embodiment and modified example, its main configuration has been described. Consequently, the configuration of the printer 10 should not be limited to the above-described configuration. Moreover, it is not intended to exclude the configuration equipped by the general printers. Moreover, the above-described embodiment is intended to exemplify the summary of the present invention and is not intended to limit the present invention. Many alternatives, modifications, and variations are apparent to those skilled in the art.

For example, the configuration has been described in which, as the conveying unit 50, three pairs of conveying rollers 51, 52, and 53 sandwich and hold the plate 90 and convey the plate 90. However, the conveying unit 50 should not be limited to this configuration, and the number of conveying roller pairs may be decreased or may be increased. For example, the plurality of paired rollers 51, 52, and 53 each of which come in contact with the side faces of the plate by the urging force acting toward the inner side and convey the plate 90 while sandwiching and holding the plate 90 between them, are not limited to three and may be two or more. Moreover, a part of the configuration may be performed by, not rollers, one pair of plate members that oppose to each other and swing in the Y direction. These plate members are brought in contact with the side faces of the plate 90 and move in the conveyance direction (XY direction) while sandwiching and holding the plate 90 between them with an urging force by an urging member such as a spring, thereby conveying the plate 90.

Moreover, as the suppressing members of the suppressing guide unit 40, the examples of one pair of suppressing rollers 41 and one pair of the plate members 42 have been shown. However, without being limited to these examples, both members may be configured with rollers or both members may be configured with plate members. Moreover, without using one pair of suppressing members, it may be configured that the suppressing member is disposed at one side.

Although embodiments of the present invention have been described and illustrated in detail, the disclosed embodiments are made for purpose of illustration and example only and not limitation. The scope of the present invention should be interpreted by terms of the appended claims.

What is claimed is:

1. A printer that performs printing for a glass plate provided with a print region and used for a preparation slide, the printer comprising:

a conveying unit that includes a plurality of paired rollers adapted to sandwich both side faces of the plate in a width direction orthogonal to a conveyance direction of the plate, brings the paired rollers respectively in contact with the both side faces of the sandwiched plate by urging each of the paired rollers with an urging force of an elastic member, and conveys the plate in the conveyance direction by the plurality of the paired rollers while sandwiching the plate by rotating each of the paired rollers with a driving force of a drive motor;

a printing unit that includes a printhead and a swinging unit adapted to swing the printhead between a printing position and a retracting position apart from the printing position, shifts the printhead to the printing position by the swinging unit when printing, brings the printhead in contact with the print region on the surface of the plate being conveyed by the conveying unit, and performs printing for the print region by the printhead; and a suppressing guide unit that regulates floating-up of the plate when printing by coming in contact with the plate from a surface side only on a neighborhood region of the side face so as not to come in contact with an observation region at a center in the width direction of the plate on a surface of the plate being conveyed by the conveying unit;

wherein the suppressing guide unit includes one pair of plate members disposed on the both side-faces of the plate.

2. The printer according to claim 1, comprising:

a platen roller that is disposed at the printing position so as to oppose the printhead and comes in contact with a back surface of the plate being conveyed.

3. The printer according to claim 1, wherein the suppressing guide unit further includes one pair of suppressing rollers disposed on the both side-faces.

4. The printer according to claim 3, wherein a distance from the one pair of plate members to the printing position is shorter than a distance from the one pair of suppressing rollers to the printing position.

5. The printer according to claim 1, further comprising: a stacker that is disposed on an outside of a discharge port through which the plate having been printed is discharged and stacks the discharged plate, wherein the one pair of plate members are disposed between the discharge port and the printing position in the conveyance direction.

6. The printer according to claim 1, wherein the conveying unit includes three sets of the paired rollers and the three sets of the paired rollers are rotated by a driving force of the one drive motor.

7. A printer that performs printing for a glass plate provided with a print region and used for a preparation slide, the printer comprising:

a conveying unit that includes a plurality of paired rollers adapted to sandwich both side faces of the plate in a width direction orthogonal to a conveyance direction of the plate, brings the paired rollers respectively in contact with the both side faces of the sandwiched plate by urging each of the paired rollers with an urging force of an elastic member, and conveys the plate in the conveyance direction by the plurality of the paired rollers while sandwiching the plate by rotating each of the paired rollers with a driving force of a drive motor;

a printing unit that performs printing for the print region on a surface of the plate being conveyed by the conveying unit at a printing position;

a stacker that is disposed on an outside of a discharge port through which the plate having been printed is discharged and stacks the discharged plate; and a suppressing guide unit that is disposed between the discharge port and the printing position and regulates floating-up of the plate when discharging by coming in contact with the plate from a surface side only on a neighborhood region of the side face so as not to come in contact with an observation region at a center in the width direction of the plate on a surface of the plate being conveyed by the conveying unit, wherein the suppressing guide unit includes one pair of plate members disposed on the both side-faces of the plate.

8. The printer according to claim 7, wherein the paired rollers are disposed between the suppressing guide unit and the discharge port.

9. The printer according to claim 7, wherein the conveying unit includes three sets of the paired rollers and the three sets of the paired rollers are rotated by a driving force of the one drive motor.

* * * * *